US008220365B2

(12) United States Patent
Yang

(10) Patent No.: US 8,220,365 B2
(45) Date of Patent: Jul. 17, 2012

(54) PLANETARY GEAR-DRIVEN MAGNIFICATION DRIVING TOOL

(76) Inventor: Tai-Her Yang, Dzan-Hwa (TW)

( * ) Notice: Subject to any disclaimer, the term of this patent is extended or adjusted under 35 U.S.C. 154(b) by 316 days.

(21) Appl. No.: 12/461,537

(22) Filed: Aug. 14, 2009

(65) Prior Publication Data

US 2011/0036208 A1 Feb. 17, 2011

(51) Int. Cl.
*B25B 17/02* (2006.01)
*B25B 13/48* (2006.01)

(52) U.S. Cl. ..... 81/56; 81/55

(58) Field of Classification Search ..... 81/56, 57, 81/57.31, 55
See application file for complete search history.

(56) References Cited

U.S. PATENT DOCUMENTS 1,343,667 A * 6/1920 Evensen ..... 81/56
2,537,382 A * 1/1951 Valentin ..... 81/56
2,955,496 A * 10/1960 La Torre ..... 81/56
3,472,083 A * 10/1969 Schnepel ..... 475/317
3,916,734 A * 11/1975 Sawan ..... 81/56
3,942,398 A * 3/1976 Fletcher et al. ..... 81/56
3,979,965 A * 9/1976 Vuceta ..... 74/410
4,403,529 A * 9/1983 Ikeda et al. ..... 81/56
5,123,308 A * 6/1992 Shaffer ..... 81/57.31
5,238,461 A * 8/1993 Gotman ..... 475/248
5,354,246 A * 10/1994 Gotman ..... 475/248
5,582,079 A * 12/1996 Matsumura et al. ..... 81/56
5,616,095 A * 4/1997 Pruitt ..... 475/178
5,953,965 A * 9/1999 Kaneyama et al. ..... 81/55
5,964,128 A * 10/1999 Kaneyama et al. ..... 81/56
6,053,080 A * 4/2000 Kaneyama et al. ..... 81/469
6,058,810 A * 5/2000 Junkers ..... 81/56
6,487,940 B2 * 12/2002 Hart et al. ..... 81/57.14
7,225,707 B2 * 6/2007 Knopp ..... 81/57
7,794,355 B2 * 9/2010 Pusateri ..... 475/331
7,987,745 B2 * 8/2011 Gauthier et al. ..... 81/57.31
2010/0018366 A1 * 1/2010 Hu ..... 81/436
2010/0180731 A1 * 7/2010 Gauthier et al. ..... 81/57

* cited by examiner

*Primary Examiner* — David B Thomas
(74) *Attorney, Agent, or Firm* — Bacon & Thomas, PLLC

(57) ABSTRACT

The present invention of a planetary gear-driven magnification driving tool relies on randomly attachable and removable planetary gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

15 Claims, 7 Drawing Sheets

PLANETARY GEAR-DRIVEN MAGNIFICATION DRIVING TOOL

BACKGROUND OF THE INVENTION (a) Field of the Invention

The traditional gear-driven screw and nut set installs the outer ring gear on the nut, and installs the planetary gear on the bolt. The screw and nut set must be installed in the planetary gear set structure one by one which entails a relatively high production cost. The present invention of a planetary gear-driven magnification driving tool relies on randomly attachable and removable planetary gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

(b) Description of the Prior Art

The planetary gear-driven screw and nut set installs the outer ring gear on the nut, and installs the planetary gear on the bolt. The screw and nut set must be installed in the planetary gear set structure one by one. Each screw and nut set must all be installed on the gear set which entails a relatively high production cost.

SUMMARY OF THE INVENTION

The present invention of a planetary gear-driven magnification driving tool relies on randomly attachable and removable planetary gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

Figure 1:
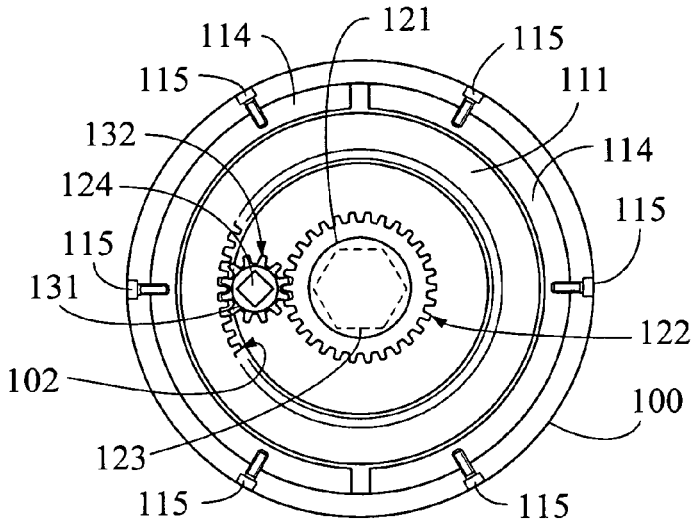
FIG. 1 is a top cross-sectional view of the present invention

DESCRIPTION OF MAIN COMPONENT SYMBOLS (100): Cover
(101): Nut
(102): Inner ring gear
(103): Sleeve
(111): Nut-driven ring body
(112): Inner thread
(114): Radial locking structure
(115): Fix screw
(121): Sun gear cylinder
(122): Cylindrical gear
(123): Polyhedral prismatic structure
(123'): Sleeve with inner polygonal hole
(124): Polyhedral cylinder
(124'): Inner polygonal hole
(131): Planetary gear cylinder
(132): Planetary gear structure
(140): Stud
(141): Inner polygonal hole
(141'): Polyhedral cylinder
(142): Thread
(200): Structure
(300): Fixed element

DETAILED DESCRIPTION OF THE PREFERRED EMBODIMENTS

The traditional gear-driven screw and nut set installs the outer ring gear on the nut, and installs the planetary gear on the bolt. The screw and nut set must be installed in the planetary gear set structure one by one which entails a relatively high production cost. The present invention of a planetary gear-driven magnification driving tool relies on randomly attachable and removable planetary gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

FIG. 1 is the top cross-sectional view of the present invention.

Figure 2:
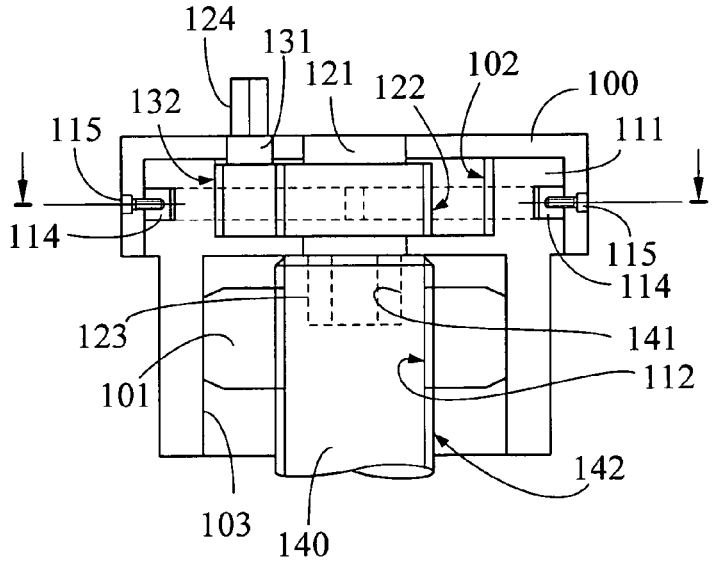
FIG. 2 is a cross-sectional view of the present invention
Figure 3:
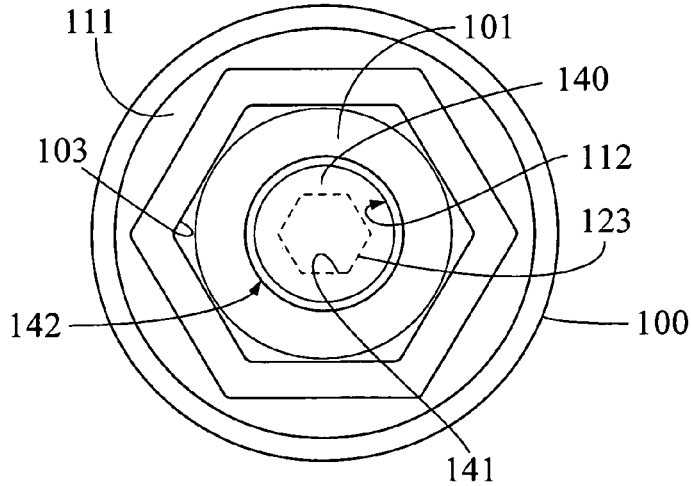
FIG. 3 is a bottom view of the present invention

FIG. 2 is a cross-sectional view of the present invention FIG. 3 is a bottom view of the present invention.

Figure 4:
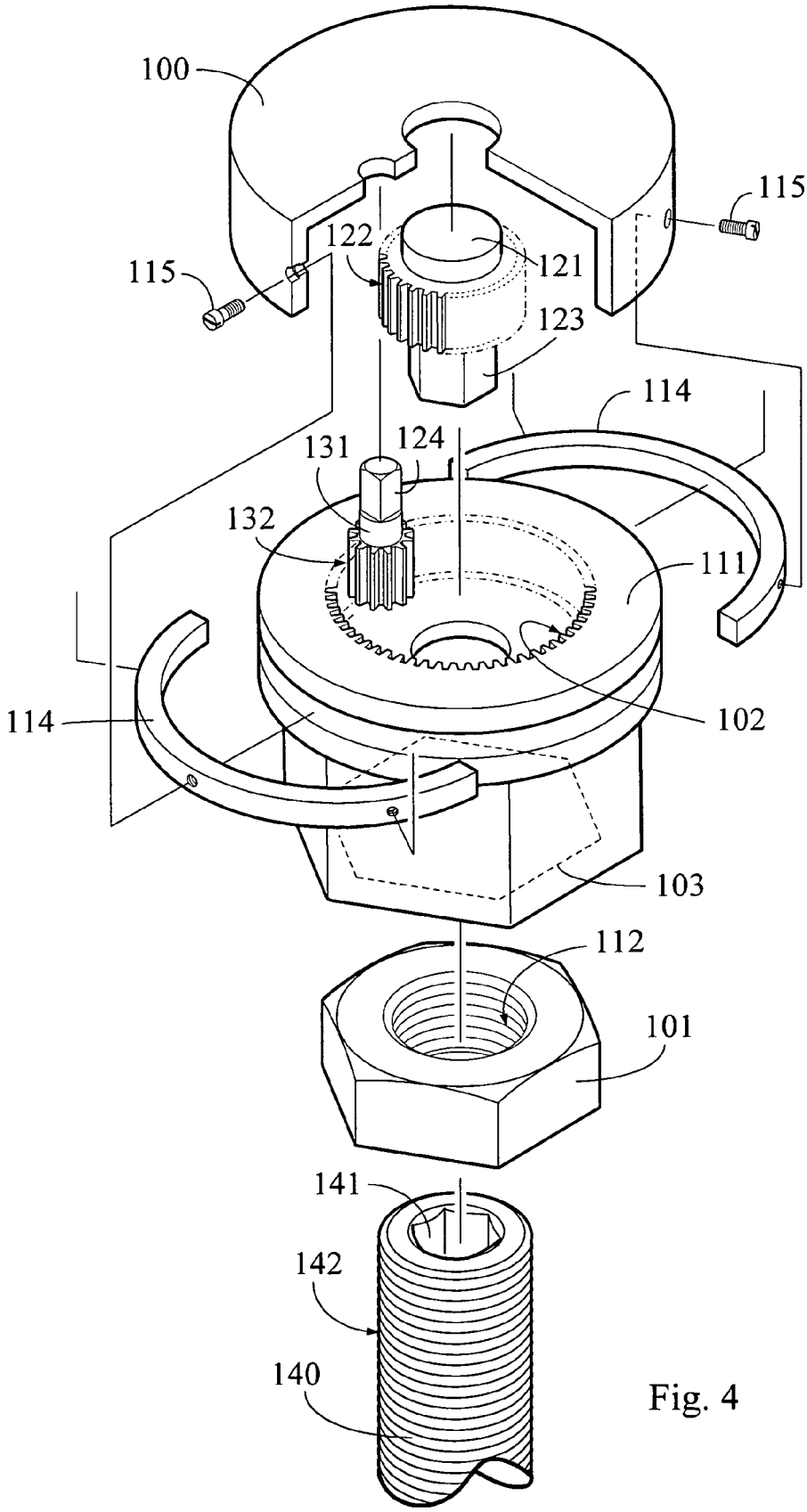
FIG. 4 is a dimensional exploded view of the present invention

FIG. 4 is a dimensional exploded view of the present invention.

Figure 5:
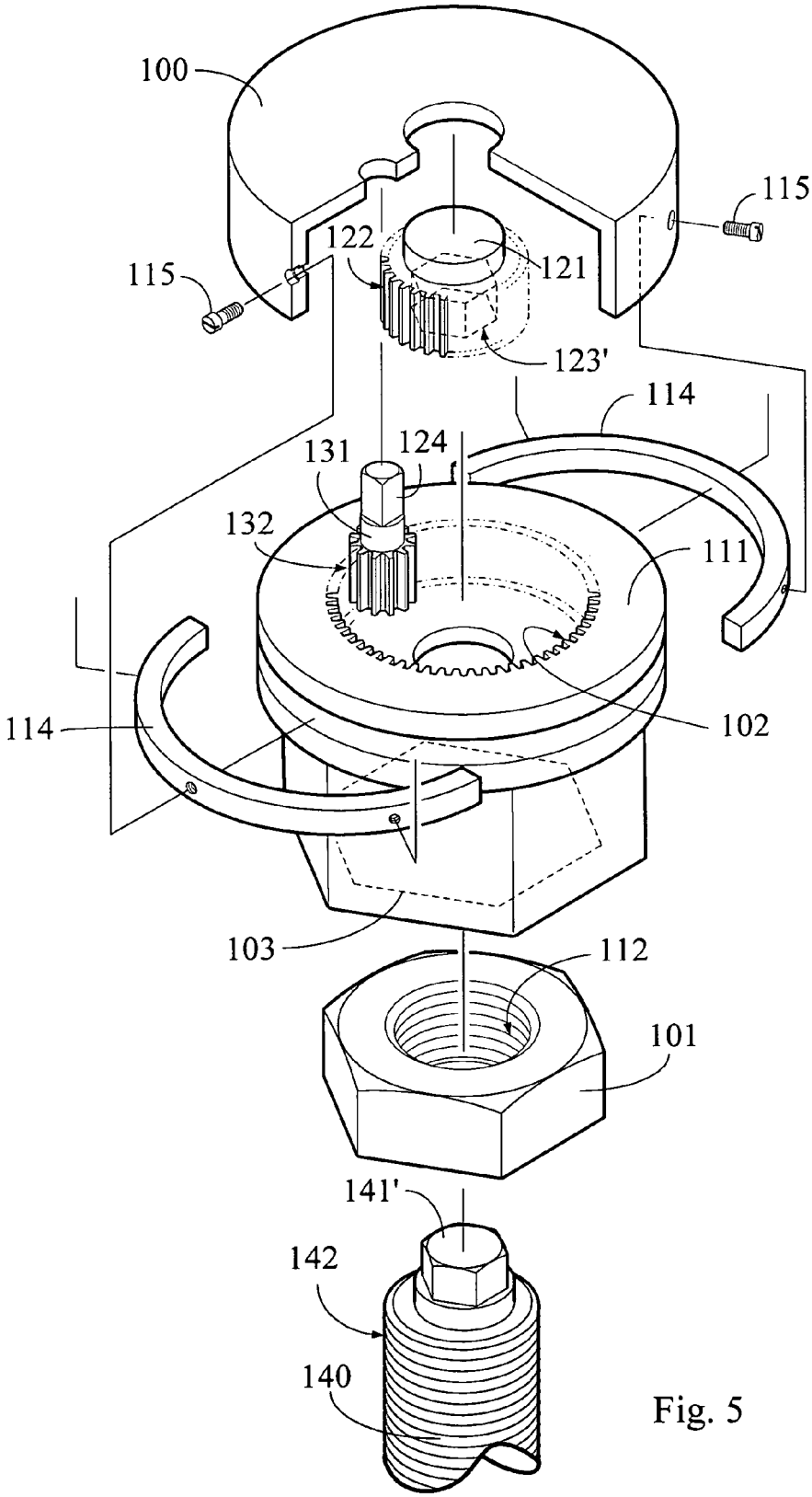
FIG. 5 is a dimensional view of the polyhedral cylinder (141') replacing the inner polygonal hole (141) in FIG. 1 to FIG. 4 of the present invention
Figure 6:
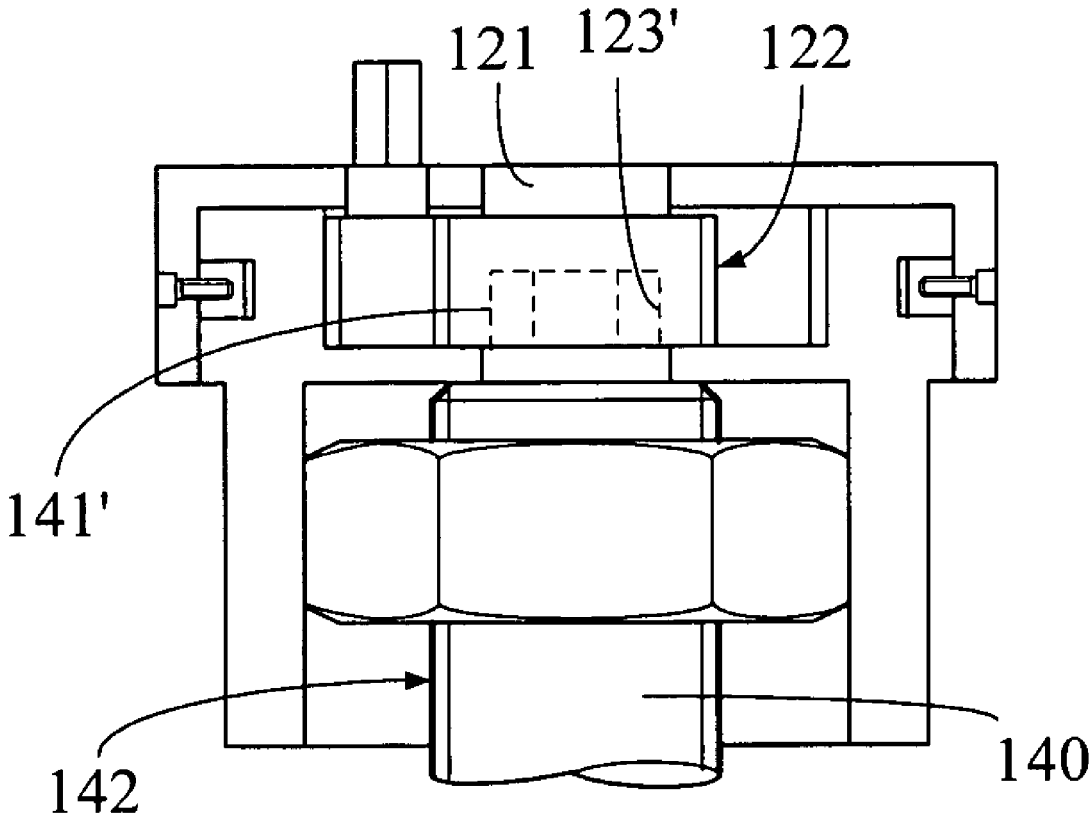
FIG. 6 is a sectional view of FIG. 5

As shown in FIG. 1 to FIG. 4, the present invention drives the following screw and nut devices including:

Nut (101): A structure with polygonal exterior and inner thread (112) on inner part for fastening on the thread (142) of the stud (140);

Stud (140): Includes threads (142) while the stud head includes inner polygonal hole (141) or it assumes the form of a polyhedral cylinder (141');

The aforementioned inner polygonal hole (141) on the stud (140) is optionally replaced by the polyhedral cylinder (141') as shown in the dimensional view in FIG. 5 wherein the polyhedral cylinder (141') replaces the inner polygonal hole (141) in FIG. 1 to FIG. 4. When the polyhedral cylinder (141') is chosen to be installed, the polyhedral prismatic structure (123) coupled with the polyhedral cylinder (141') will be transformed into a sleeve with inner polygonal hole (123') in order to fit into and drive the polyhedral cylinder (141'). FIG. 6 is a cross-sectional view of the FIG. 5.

The main components of the planetary gear-driven magnification driving tool include:

Cover (100): A bottle cap-shape locking structure (114) that axially or radially combines with the upper outer ring of the nut-driven ring body (111) by means of a fix screw (115) in order to protect the planetary gear set. The cover (100) includes axial hole to support the sun gear cylinder (121) and through hole in the planetary gear cylinder (131) for the installation of the inner polygonal hole (124') or the polyhedral cylinder (124) in order to couple with tools to drive the planetary gear cylinder (131).

Nut-driven ring body (111): A ring shape structure with its an integrated inner ring structure or installed with an inner ring gear (102) in an assembly manner. The lower section of the structure has sleeve (103) to couple with the exterior side of the nut (101) so that when the inner ring gear (102) is driven, nut (101) is loosen or locked by its rotating or counter-rotating motion.

Sun gear cylinder (121): The sun gear cylinder is a cylindrical structure with its integrated top section or formed into cylindrical gear (122) by assembly method. The upper section of the sun gear cylinder (121) couples with the axial hole of the cover (100) while its lower section is made in one piece or as an assembly, assuming a polyhedral prismatic structure (123) for coupling and movement with the inner polygonal hole (141) on the top side of the threaded (142) of the stud (140). Another way is to integrate into one body or form as an assembly the lower side of the aforementioned polyhedral prismatic structure (123) into a sleeve (123') with inner polygonal hole to couple and move with the polyhedral cylinder (141') on the top side of the threaded (142) of the stud (140).

Planetary gear (131): A planetary gear structure (132) is at the lower section of the planetary gear cylinder for coupling between the sun gear (122) of the sun gear cylinder (121) and the inner ring gear (102) of the nut-driven ring body (111) in order to form an interactive planetary gear set function. The upper section of the planetary gear cylinder (131) is equipped with a polyhedral cylinder (124) or inner polygonal hole (124') for coupling randomly with external separated operational tools so that it could accept drive from coupled operational tools; or the operational tool is formed as an assembly with the planetary gear cylinder (131) or integrated as a single structure.

The aforementioned installation is comprised of at least one planetary gear stud (13) and planetary gear structure (132).

The above-mentioned nut-driven ring body (111), sun gear cylinder (121), planetary gear cylinder (131) and the tools formed for driving the planetary gear cylinder (131) form the planetary gear-driven magnification driving tool.

The aforementioned planetary gear-driven magnification driving tool, wherein the operational tool is the optional screwdriver. The inner polygonal hole (141) of stud (140) and/or the inner polygonal hole (124') of the planetary gear cylinder (131) are converted into structures with slots to couple with the working end shape of the screw driver.

Figure 7:
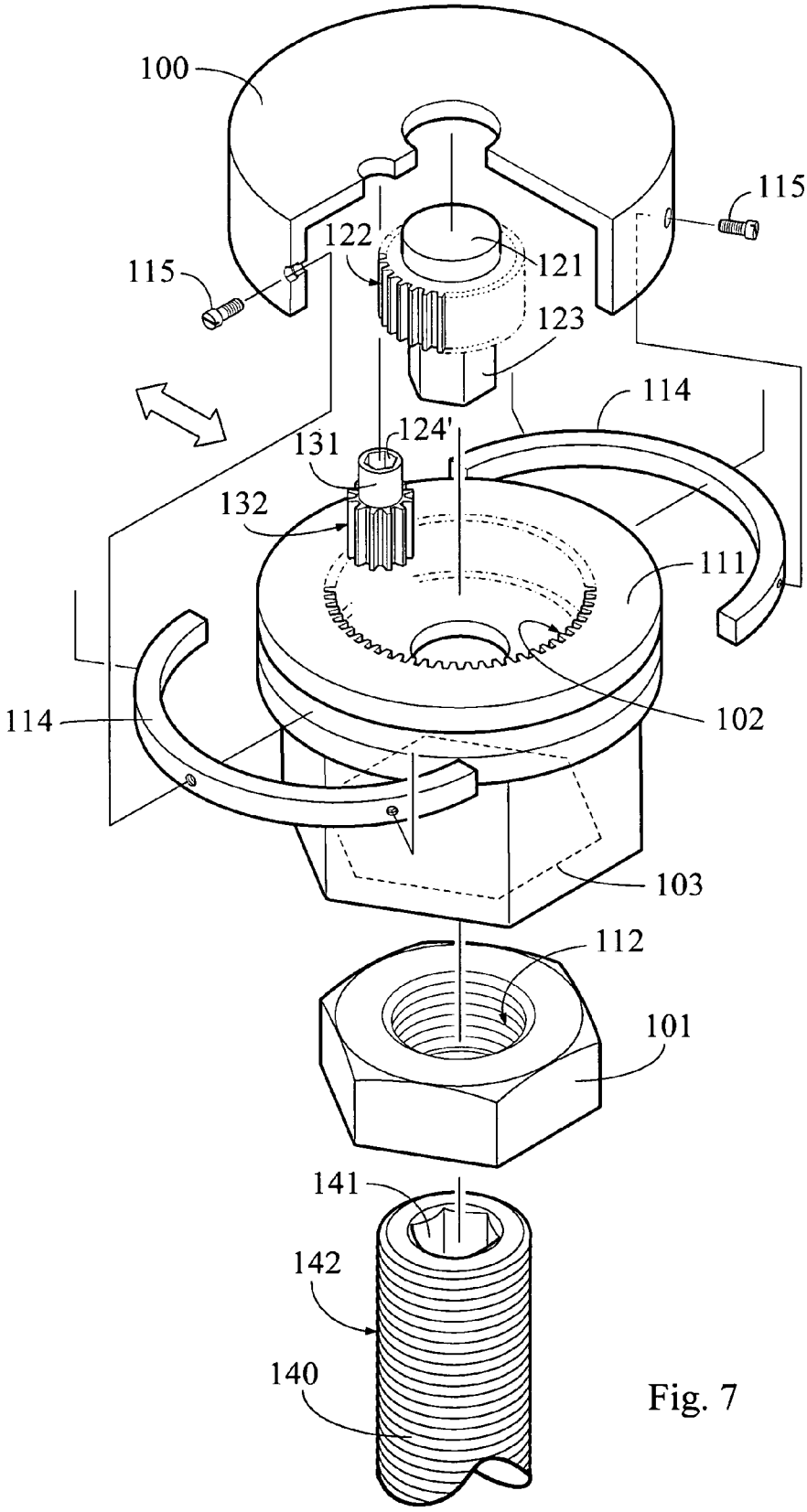
FIG. 7 is a dimensional view of the inner polygonal hole (124') replacing the polyhedral cylinder (124) in FIG. 1 to FIG. 4
Figure 8:
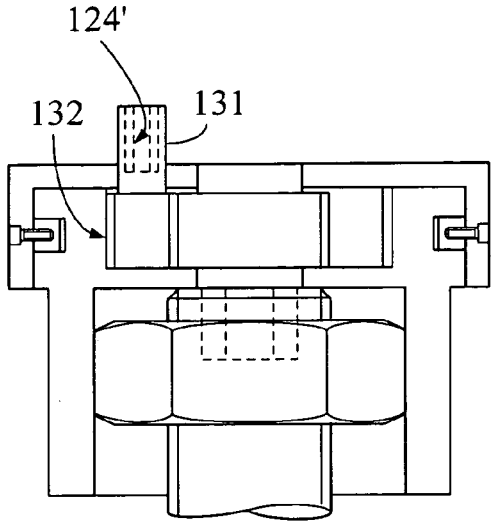
FIG. 8 is a cross-sectional view of the FIG. 7

The aforementioned planetary gear-driven magnification driving tool, wherein the polyhedral cylinder (124) is optionally replaced by the inner polygonal hole (124') as shown in the dimensional view in FIG. 7 wherein the inner polygonal hole (124') replaces the polyhedral cylinder (124) in FIG. 1 to FIG. 4. When the inner polygonal hole (124') is chosen to be installed, the formation will be as shown in the cross-sectional view of FIG. 7. FIG. 8 is a cross-sectional view of the FIG. 7.

The present invention of a sun gear coaxially driven screw and nut structure relies on manpower or fluid motor or mechanical power or electric motor to drive the operational tool which in turn drive the planetary gear cylinder (131); and to further drive the nut-driven ring body (111) with the inner ring gear (102). According to the speed reduction multiples of the planetary gear set, a magnification effect is produced to drive the nut (101) for locking on or loosening from the thread (142) of the stud (140) head.

Figure 9:
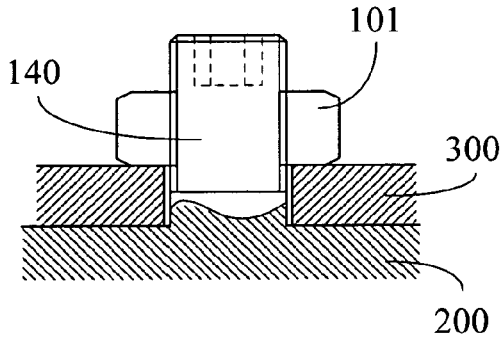
FIG. 9 is a functional view of the driven stud (140) being welded on the structure (200)
Figure 10:
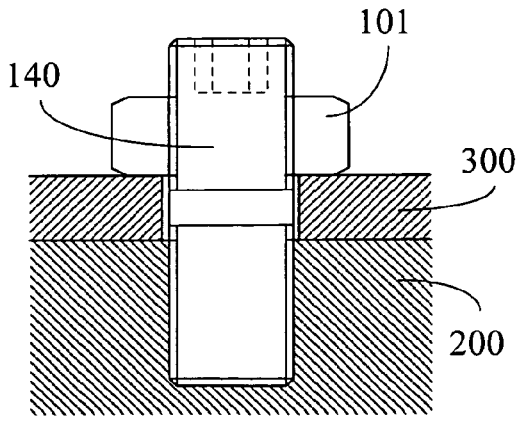
FIG. 10 is a functional view of the stud (140) being screwed on the screw hole of the structure (200) of the present invention
Figure 11:
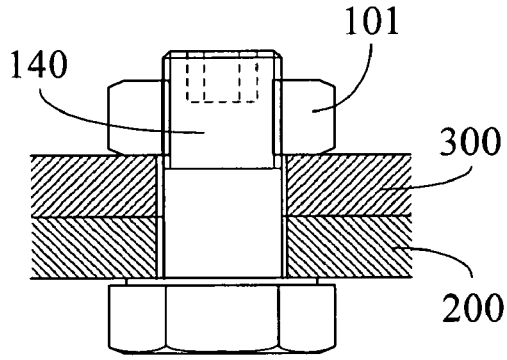
FIG. 11 is a functional view of the present invention showing the stud 140 penetrating the structure with the other end installed with a nut
Figure 12:
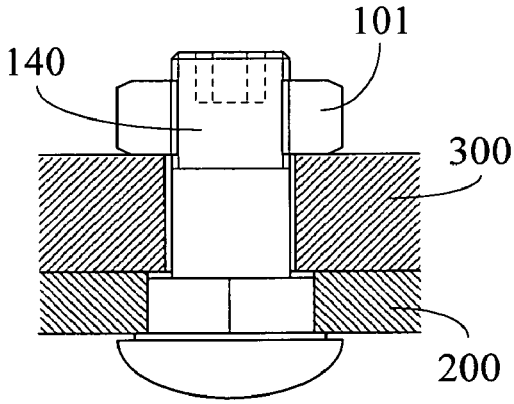
FIG. 12 is a functional view of the stud (140) of the present invention penetrating through the structure (200) with a limit stud bolt head at the other end
Figure 13:
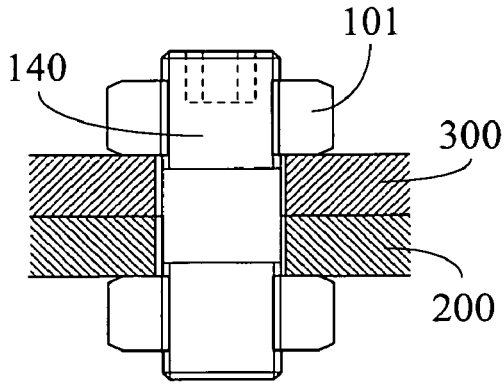
FIG. 13 is a functional view of the present invention showing both ends of the stud (140) installed with nuts (101)

Anti-vibration padding ring or gasket is optionally installed in the space between the drivable nut (101) and the stud (140) of the planetary gear-driven magnification driving tool or the nut is directly screwed on the thread (142) of the stud (140). The bottom end of the stud (140) serves as:

1) The stud (140) is welded on the structure (200) and the nut (101) is screwed on the stud (140) to lock or release the fixed element (300), its characteristics is that the stud is facing towards the rear end of the tool, and it contains an inner polygonal hole or polyhedral; FIG. 9 is a functional view of the present invention showing the driven stud (140) being welded on the structure (200); or 2) The stud (140) is screwed into the screw hole of the structure (200) by means of the stud structure and the nut (101) is screwed on the stud (140) in order to lock or release the fixed element (300), its characteristics is that the stud is facing towards the rear end of the tool, and it contains an inner polygonal hole or polyhedral; FIG. 10 is a functional view of the present invention showing the stud (140) being screwed into the screw hole of the structure (200); or 3) The stud (140) penetrates through the structure (200) with a nut at the other end joined to the structure (200); the nut (101) serves to screw onto the stud (140) in order to lock or release the fixed element (300), its characteristics is that the stud is facing towards the rear end of the tool, and it contains an inner polygonal hole or polyhedral; FIG. 11 is a functional view of the present invention showing the stud (140) penetrating the structure with the other end installed with a nut; or 4) The stud (140) penetrates through the structure (200) with a limit stud bolt head at the other end joined to the structure (200); the nut (101) serves to screw on the stud (140) in order to lock or release the fixed element (300), its characteristics is that the stud is facing towards the rear end of the tool, and it contains an inner polygonal hole or polyhedral; FIG. 12 is a functional view of the present invention showing the stud (140) penetrating through the structure (200) with a limit stud bolt head at the other end; or 5) The stud (140) penetrates through the structure (200) and the fixed element (300), and nuts (101) are screwed on both ends of the stud (140) in order to lock or release the fixed element (300), its characteristics is that the stud is facing towards the rear end of the tool, and it contains an inner polygonal hole or polyhedral; FIG. 13 is the functional view of the present invention showing both ends of the stud (140) installed with nuts (101);

The drive operational tool of planetary gear cylinder (131) employs one or more driving method of operational drive on the planetary gear cylinder (131) and/or stud (140) including:

1) one directional or reverse rotary drive;

2) reciprocating type one-way drive in which one driving direction produces driving effect while the other does not produce driving effect;

3) reciprocating type one-way drive in which one driving direction is chosen to produce driving effect while the other direction does not produce driving effect.

Aside from the protruding polyhedral cylinder (124) or the inner polygonal hole (124') of the planetary gear cylinder (131); and/or the protruding polyhedral cylinder (141') or the inner polygonal hole (141) of the stud (140) head, the kinds of planetary gear-driven magnification driving tool are many. The following are merely some of the several modes which are not to be used as restrictions. Coupling modes are formed by one or more of the following:

1) The planetary gear cylinder (131) can randomly couple with driving tools with T-type or L-type handles 2) The planetary gear cylinder and the T-type or L-type handle driving tool assume an integrated structure or an assembled structure 3) The randomly coupling driving tools of the planetary gear cylinder (131), or the assembly type or integrated type driving tools including the T-type or L-type handles possess articulating structure with foldable or universal adjusting angles;

4) The planetary gear cylinder (131) has inner polygonal hole (134) to accept drive modes of relatively coupleable driving tools including pulling by pulling tools or drive from rotary drive tools;

5) The planetary gear cylinder has protruding polyhedrons to accept driving modes of relatively coupling driving tools including drive by pulling tools or drive from rotary driving tools.

Aside from using various kinds of driving tools such as socket wrench, open wrench, closed wrench polygonal wrench or screwdrivers, the driving tool provided by the planetary gear-driven magnification driving tools for driving the planetary gear cylinder (131) and/or the stud (140) further include one or more of the following functional devices such as; 1) functional devices with torque limit; 2) functional devices which can adjust and set the required torque limit; 3) functional device with drive torque analog or digital display; 4) functional device that display drive torque with sound or voice; 5) functional device that displays drive torque with lamps.

The invention claimed is:

1. A planetary gear-driven driving tool for rotating an internally-threaded nut relative to an externally-threaded stud structure, said externally-threaded stud structure including an axially-extending polygonal inner blind hole, opening, or projection at a top end, comprising:

a cover arranged to be secured to a nut driving ring body, said cover including a central opening for rotatably receiving a sun gear cylinder, and an opening for rotatably mounting a planetary gear, wherein said nut driving ring body includes a ring gear and a downwardly extending sleeve that fits over the nut to cause the nut to rotate with the nut driving body, wherein said sun gear cylinder supports a sun gear and polyhedral prismatic structure that engages said polygonal opening or polygonal projection at the top end of the stud structure to prevent relative rotation between the sun gear and the stud structure when the nut is driven by the nut driving ring body, said planetary gear being engaged with the sun gear and the ring gear, wherein said planetary gear includes at least one planetary gear stud that extends through said cover, said planetary gear stud being rotated by a driving device to cause said planetary gear to rotate, and wherein rotation of said planetary gear causes relative rotation between the ring gear and the sun gear, thereby causing the nut driving body to exert a magnified driving force on the nut.

2. A planetary gear-driven driving tool as claimed in claim 1, wherein said cover is arranged to be axially or radially mounted on said nut driving ring body by a locking structure said locking structure being retained by said nut driving body and fixed to said cover by screws.

3. A planetary gear-driven driving tool as claimed in claim 2, wherein said locking structure includes semi-circular structures extending into and engaged by a groove in a side of said nut driving body.

4. A planetary gear-driven driving tool as claimed in claim 1, wherein said sun gear is formed in a surface of said sun gear cylinder and said polyhedral prismatic structure is integral with or assembled to said sun gear cylinder.

5. A planetary gear-driven driving tool as claimed in claim 4, wherein said polyhedral prismatic structure is one of a polyhedral opening in said sun gear cylinder for engagement with said polygonal projection of the stud structure or a polyhedral extension of said sun gear cylinder for engagement with a polygonal opening in the stud structure.

6. A planetary gear-driven driving tool as claimed in claim 1, wherein said planetary gear stud has a polygonal surface or a polygonal opening for coupling with the driving tool to rotate said planetary gear.

7. A planetary gear-driven driving tool as claimed in claim 1, wherein the driving device is integral with the planetary gear stud.

8. A planetary gear-driven driving tool as claimed in claim 1, wherein the driving device is a crew driver and the planetary gear stud includes a slot for receiving the screw driver.

9. A planetary gear-driven driving tool as claimed in claim 1, wherein said driving device is driven manually, by a fluid motor, by mechanical power, or by electric power.

10. A planetary gear-driven driving tool as claimed in claim 1, wherein the stud structure extends from a structural element, and wherein a fixed element is sandwiched between the structural element and the nut, the nut being rotated by the driving device to lock or release the fixed element.

11. A planetary gear-driven driving tool as claimed in claim 1, wherein said cover has a bottle cap shape to protect said ring, sun, and planetary gears.

12. A stud structure driven by the planetary gear-driven magnification driving tool, wherein said driving tool comprises a cover arranged to be secured to a nut driving ring body, said cover including a central opening for rotatably receiving a sun gear cylinder, and an opening for rotatably mounting a planetary gear, wherein:

said nut driving ring body includes a ring gear and a downwardly extending sleeve that fits over the nut to cause the nut to rotate with the nut driving body, said sun gear cylinder supports a sun gear and engages said stud structure to prevent relative rotation between the sun gear and the stud structure when the nut is driven by the nut driving ring body, said planetary gear is engaged with the sun gear and the ring gear, said planetary gear includes at least one planetary gear stud that extends through said cover, said planetary gear stud being rotated by a driving device to cause said planetary gear to rotate, and rotation of said planetary gear causes relative rotation between the ring gear and the sun gear, thereby causing the nut driving body to exert a magnified driving force on the nut, and wherein the stud structure faces a rear end of the tool and contains an inner polygonal hole or polyhedral surface for engagement with said polyhedral surface or polygonal hole of said sun gear cylinder.

13. A stud structure as claimed in claim 12, wherein a bottom end of the stud structure is screwed into a screw hole of a structural element and the nut is screwed on the stud structure in order to lock or release the fixed element positioned between the nut and the structural element.

14. A stud structure as claimed in claim 13, wherein the bottom end of the stud structure includes a polygonal bold head, a polygonal surface and curved bolt head, or a threaded section arranged to be threaded into a second nut.

15. A stud structure as claimed in claim 12, wherein a bottom end of the stud structure penetrates through a structural element, said nut being threaded onto the stud structure to lock or release the fixed element.

* * * * *